United States Patent [19]

Boutros

[11] Patent Number: 4,580,447

[45] Date of Patent: Apr. 8, 1986

[54] FUNCTION TEST EQUIPMENT FOR SMOKE AND GAS MUNITIONS

[75] Inventor: Mansour Z. Boutros, Thomson, Ill.

[73] Assignee: The United States of America as represented by the Secretary of the Army, Washington, D.C.

[21] Appl. No.: 599,919

[22] Filed: Apr. 13, 1984

[51] Int. Cl.[4] ..... G01L 5/14

[52] U.S. Cl. ..... 73/167; 86/1.1

[58] Field of Search ..... 73/167, 35, 432 V; 116/214; 55/270, 385 R, 385 A, DIG. 33; 340/628; 250/573; 356/438, 439; 98/43 R; 128/206.12, 206.21; 425/816; 102/334, 368; 86/1 B; 434/11

[56] References Cited

U.S. PATENT DOCUMENTS

| | | | |
|---|---|---|---|
| 3,299,620 | 1/1967 | Hollingworth | 55/485 |
| 3,772,958 | 11/1973 | Mullarkey | 86/1 B |
| 3,823,532 | 7/1974 | Cooper et al. | 55/422 |
| 3,826,180 | 7/1974 | Hayashi | 98/43 |
| 3,919,702 | 11/1975 | Hayes et al. | 250/573 |

FOREIGN PATENT DOCUMENTS

| | | | |
|---|---|---|---|
| 45-35463 | 11/1970 | Japan | 86/1 B |

*Primary Examiner*—Charles Frankfort
*Assistant Examiner*—Thomas B. Will
*Attorney, Agent, or Firm*—Anthony T. Lane; Robert P. Gibson; Michael C. Sachs

[57] ABSTRACT

Test equipment which permits smoke or tear gas grenades to be detonated indoors within an expansion chamber portion of the test equipment. The smoke or gas is then channelled through an opacity monitor which is capable of accurately measuring the volume of smoke or gas produced by the grenade. A borescoping system in the expansion chamber permits operating personnel to accurately check the duration of the smoke or gas emmission using external timing devices. After testing the smoke or gas is ducted through a high efficiency filtering system so that when exhausted into the atmosphere it is at a contamination level acceptable to federal and local air quality standards.

3 Claims, 3 Drawing Figures

FUNCTION TEST EQUIPMENT FOR SMOKE AND GAS MUNITIONS

GOVERNMENT INTEREST

The invention described herein may be manufactured and/or used by or for the Government for governmental purposes without the payment of any royalty thereon.

BACKGROUND OF THE INVENTION

The present invention relates to equipment for testing smoke and tear gas producing munitions. CS, as hereinafter used refers to teargas. At present such munitions are function tested outdoors in open air. Testing in this manner presents a number of disadvantages. For example, tests must be scheduled to accommodate various weather conditions. Wind, rain, snow, etc. can all have a detrimental impact on such testing as well as on test personnel. In addition, atmospheric conditions must be considered prior to a test to assure that federal or local air quality standards are not violated. Existing federal and state air quality standards can delay open air testing of these munitions, and proposed tightening of air quality standards may prohibit such testing except in special isolated locations. Finally, there is currently no means available to obtain quantitive measurements which assure efficiency of the munition item being tested. Clearly the need exists for a test device which will allow testing to be conducted indoors without emitting harmful pollutants and which will provide for accurate measurement of various performance characteristics.

SUMMARY OF THE INVENTION

The present invention relates to equipment which permits smoke or tear gas grenades to be detonated indoors within an expansion chamber portion of the unit. The smoke or gas is then channelled through an opacity monitor which is capable of accurately measuring the volume of smoke or gas produced by the grenade. Observation windows in the firing chamber facilitate calibration of the monitor. A commercial borescoping system in the expansion chamber permits operating personnel to accurately check the duration of the smoke or gas emission using external timing devices. After opacity readings are taken the smoke/gas is ducted through a high efficiency filtering system to remove environmental pollutants. An activated carbon filter is used in the system when tear gas grenades are being tested. The carbon filter assembly is designed to be easily removed from the system when smoke grenades are being tested. This removal increases the life of the carbon filter. In this manner the test equipment can accommodate both types of grenades. From the filters the smoke/gas is exhausted into the atmosphere at a contamination level acceptable to federal and local air quality standards.

DETAILED DESCRIPTION OF PREFERRED EMBODIMENT

Figure 1:
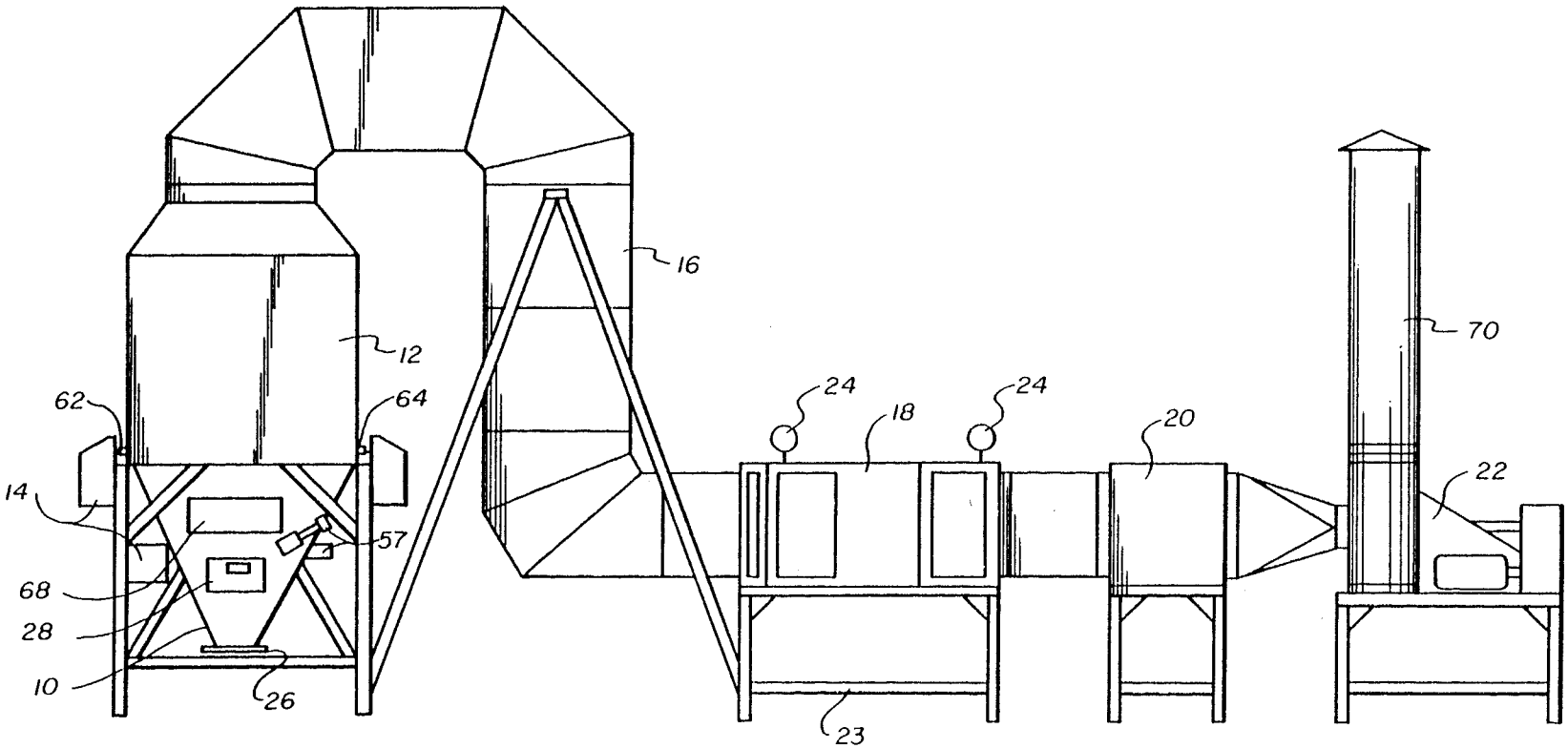
FIG. 1 is a schematic illustration of the smoke and CS munition function test equipment.

Referring now to FIG. 1, there is shown smoke and CS munition function test equipment comprising a firing chamber 10, expansion chamber 12, smoke opacity monitoring system 14, exhaust ducts 16, smoke filtering system 18, CS filtering system 20, variable speed exhausting system 22 and supporting steel structures 23. Vacuum gauges 24 are provided to monitor the drop in pressure on downstream side of the filters when the system is in use. The pressure-equating valve 26 allows fresh air to enter while exhausting the system. Components of the firing chamber 10 are: a pulley drawer 28 for activating smoke and tear gas grenades, a borescoping system 57 to provide an easement for emission timing of grenades, a pressure equating valve 26 to maintain atmospheric pressure inside the equipment and for viewing windows 68 with clamp and hinges (not shown).

Figure 2:
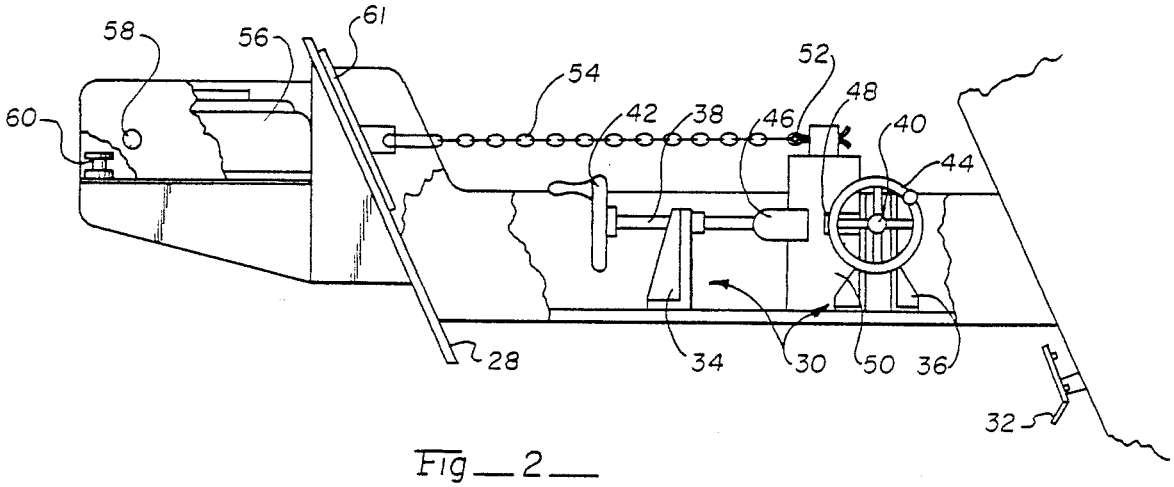
FIG. 2 is a side elevation view, partly in section, of the pulling drawer assembly.

Components of the firing chamber 10 are shown in detail in FIG. 2. Here there is shown the pulling drawer 28 which opens on slides not shown, to permit access to the grenade holding fixture 30. Clamps 32 are provided to lock the pulling drawer 28 in the closed position when the system is in use. The grenade fixture consists of brackets 34, 36 which support threaded shafts 38, 40. Shafts 38, 40 having handwheels 42, 44 at one end and feet 46, 48 at the other end are adapted to secure the grenade 50, which is clamped securely in position, as shown. It should be noted that the safety pin 52 in the grenade 50 must be aligned with the direction of drawer movement to assure accurate measurement of pulling force of the pin 52. After securing the grenade in the drawer the safety pin 52 is connected to the pulling chain 54. The opposite end of the chain 54 is attached to a force gauge 56 which is used to measure the amount of force required to pull the pin 52 from the grenade 50. Handle 58 and a similar handle on the opposite side (not shown) of the gauge are provided to pull the gauge rearwardly which simultaneously pulls the pin 52 from the grenade 50 by means of interconnecting chain 54 and registers the pulling force on the gauge 56. Retractable plunger 60 locks gauge 56 at the rearward limit of its travel and, therefore, secures the gasketed plate 61 in closed position, thus sealing the pass opening of the force gauge 56.

Figure 3:
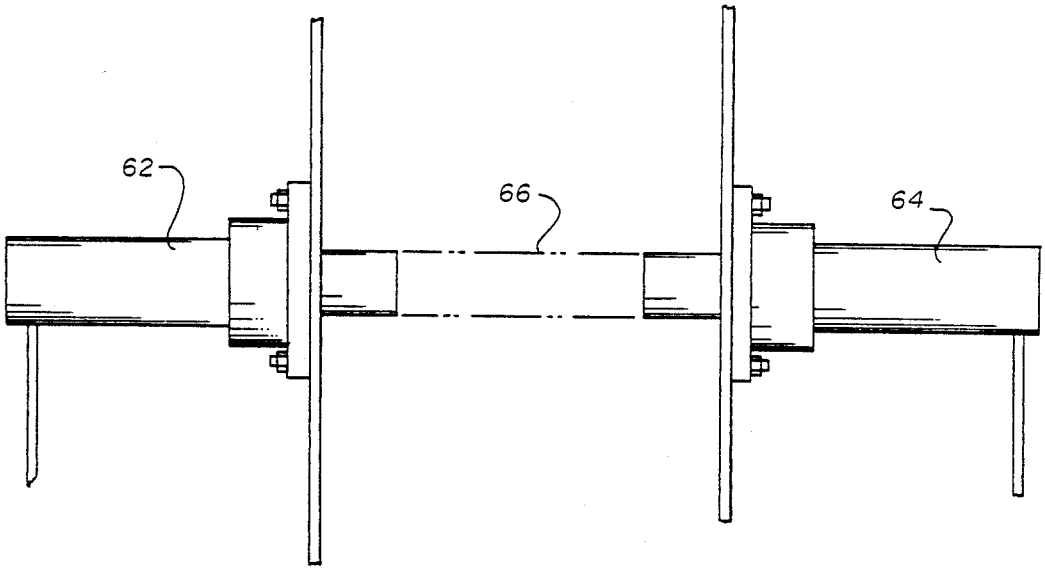
FIG. 3 is a schematic illustration of a transmissiometer at the opacity monitor station.

FIG. 3 shows the arrangement of the single pass transmissiometer 62, 64 used in the smoke opacity monitoring system 14 shown in FIG. 1. The transmissiometer 62, 64 is situated above the pulling drawer 28 at the mouth of the expansion chamber 12 show in FIG. 1. Interruption of the light beam 66 (FIG. 3) between the transmissiometer elements 62, 64 by the smoke emitted from a detonated grenade is sensed by the transmissiometer and is relayed to the opacity monitor 14. The opacity reading is graphically or digitally displayed on the monitor for comparison against established standards. It should be noted that the opacity monitor and transmissiometer used are commercially available items, well known in the art, such as the Model 301 Opacity Monitoring System manufactured by Dynatron Incorporated.

In operation, the opacity monitor should first have zero adjustment in accordance with the manufacturers instructions. The transmissiometer is then activated and the exhaust system 22 (FIG. 1) is turned on. Clamps 32 (FIG. 2) are next released to permit the pulling drawer 28 to be opened. The grenade 50 to be tested is then clamped in the grenade fixture 30 as previously described in FIG. 2 and the pulling chain 54 is attached to the safety pin 52. The drawer is then closed and secured by clamps 32. Gauge handles 58 are then pulled rearwardly until plunger 60 locks the gauge slider in place. This action pulls the safety pin 52 detonating the grenade 50 and simultaneously records the pulling force on the gauge 56 as previously described in FIG. 2. The smoke emission is observed through the borescope 57 (FIG. 1) and a stop watch is used to time the duration of the emission as stipulated in the testing technical manual. This reading is recorded as are the readings from the opacity monitor 14 (FIG. 1) and the tension gauge 56 (FIG. 2) for subsequent comparison against established standards.

A fan in the exhaust system 22 draws the emitted smoke or gas through the ducts 16, through the smoke and gas filters 18, 20 until it is exhausted through stack 70. Enough fresh air enters the system through the pressure equating valve 26 to maintain atmospheric pressure in the expansion chamber. During the exhausting procedure, the pressure gauges 24 will show the degree of cleanness of the filtering system through pressure drop indications. The expansion chamber is designed to contain the maximum volume of smoke/gas emitted from one grenade without exceeding atmospheric pressure. It should be noted that the smoke filter 18 consists of three separate filter elements which combined provide nearly 100 percent filtering efficiency. These elements are (1) a disposable air filter, (2) dry cartridge prefilter, and (3) a high efficiency particulate air filter. In addition, the activated carbon filter 20 for removing tear gas is situated on a separate stand so that it can be replaced with a section of ducting when testing smoke grenades. This decreases the unnecessary consumption of the carbon filter 20 when testing the smoke grenades.

The invention in its broader aspects is not limited to the specific combinations, improvement, and instrumentalities described but departures may be made therefrom within the scope of the accompanying claims without departing from the principles of the invention and without sacrificing its chief advantages.

I claim:

1. Function test equipment for smoke and tear gas (CS) munitions comprising:

a. a firing chamber for receiving smoke and tear gas grenades to be tested, said firing chamber comprising:
   i. a pulling drawer;
   ii. a grenade holding fixture mounted in said drawer;
   iii. clamp means for locking said pulling drawer in closed positions;
   iv. pulling chain means for activating said grenades when said pulling drawer is in closed position;
   v. borescoping system to provide an easement for emission timing of said grenades;
   vi. a pressure-equating valve to maintain atmospheric pressure in said firing and expansion chambers; and
   vii. viewing windows;

b. an expansion chamber for receiving smoke and tear gas from activated said grenades;

c. an opacity monitor between said firing chamber and said expansion chamber in the path of said smoke and tear gas produced by said grenades;

d. a high efficiency filtering system for removing environmental pollutants from said smoke and tear gas;

e. ducting between said expansion chamber and said filtering system;

f. means exhausting filtered smoke and tear gas from said filters into the atmosphere; and g. supporting steel structures.

2. Function test equipment as set forth in claim 1, wherein said grenade holding fixture consists of brackets supporting threaded shafts, said shafts having handwheels at one end and grenade engaging feet on the other to support said grenades between said brackets and said feet.

3. Function test equipment as set forth in claim 1 wherein said pulling chain means includes a pulling force gauge for registering the pulling force on said pulling chain means required for activating said grenades.

* * * * *